United States Patent [19]

LaMonica et al.

[11] 4,037,844

[45] July 26, 1977

[54] CHILD'S TOY TENT CHESS BOARD

[76] Inventors: Jeanette LaMonica; Diana LaMonica, both of 14710 Blyth St., Apt. 31, Panorama City, Calif. 91402

[21] Appl. No.: 671,387

[22] Filed: Mar. 29, 1976

[51] Int. Cl.[2] ..... A63F 3/02

[52] U.S. Cl. ..... 273/136 K; 273/136 B; 273/136 D

[58] Field of Search ..... 273/136 K, 136 GA, 136 Z, 273/136 B, 136 R, 131 B, 136 D; 46/11, 13

[56] References Cited

U.S. PATENT DOCUMENTS

| | | | |
|---|---|---|---|
| 1,946,250 | 2/1934 | Whaley | 46/11 |
| 2,084,912 | 6/1937 | Klep | 273/136 K |
| 2,551,318 | 5/1951 | Drew | 273/136 K |
| 2,729,451 | 1/1956 | Larson | 273/136 B |
| 3,430,962 | 3/1969 | Davenport | 273/136 K |
| 3,847,397 | 11/1974 | Price | 273/136 B |

FOREIGN PATENT DOCUMENTS

| | | | |
|---|---|---|---|
| 582,488 | 8/1933 | Germany | 273/136 B |

*Primary Examiner*—Anton O. Oechsle
*Assistant Examiner*—Harry G. Strappello
*Attorney, Agent, or Firm*—Richard L. Miller

[57] ABSTRACT

A chess board set for appealing particularly to children, the chess board set including a conventional checker or chess board having sixty four checkered spaces, and the set also including a cover for the board which is in the design of a circus tent, the cover in one form being magnetically mountable upon the board, and in another form being pivotally attached thereto for pivoting away from the board playing field and which serves as a storage means for chess playing pieces.

4 Claims, 4 Drawing Figures

MAIN ENTRANCE
MAIN ENTRANCE

CHILD'S TOY TENT CHESS BOARD

This invention relates generally to chess sets. More specifically it relates to a chess board set.

A principal object of the present invention is to provide a chess board set that is made to appeal particularly to children by including a cover over a chess game board, the cover being in the shape of a circus tent is brightly colored and decorated so to resemble a real circus tent in order to give a happy feeling to a child.

Another object is to provide a child's toy tent chess board wherein the chess board and cover together form a case within which the chess playing pieces can be stored when not in use, so to keep all the chess components together with the chess board instead of being separated therefrom and not become misplaced from each other whenever a chess game is desired to be played.

Yet another object is to provide a child's toy tent chess board wherein the same is also suitable for use to play checkers.

Other objects are to provide a child's toy tent chess board which is simple in design, inexpensive to manufacture, rugged in construction, easy to use, and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figures 1, 2, 3, 4:
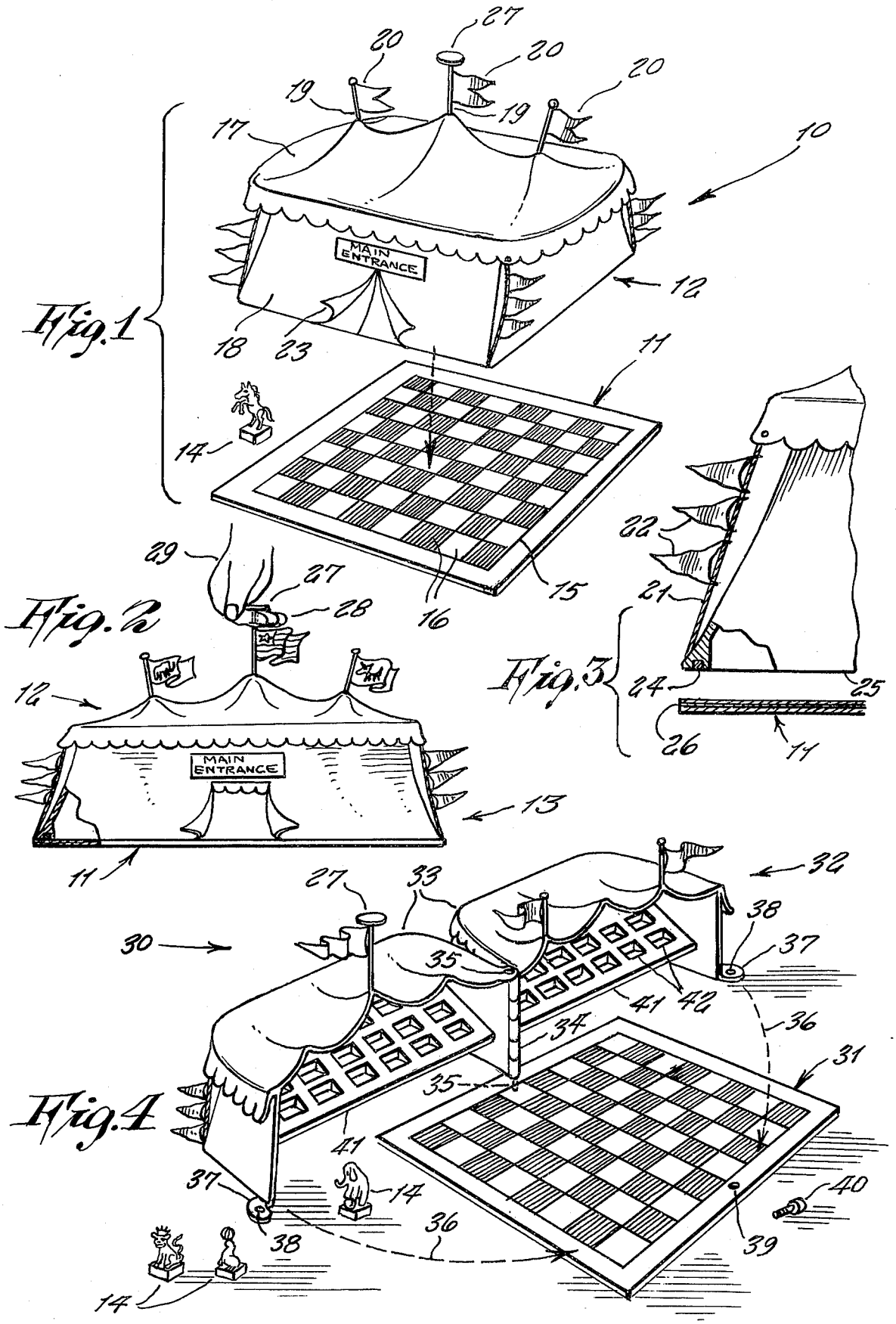
FIG. 1 is a perspective view showing one design of the present invention wherein the cover is shown raised above the chess board for being placed thereupon.
FIG. 2 is a side view of the cover and chess board shown attached together and being carried in a child's hand.
FIG. 3 is a fragmentary cross sectional side view of the chess board and cover and illustrating a magnetic means for securement together.
FIG. 4 is a perspective view of a modified design of the invention wherein the cover is pivotally attached to the chess board so that the cover is pivotable out of the way when the chess board is wished to be used for playing a game of chess or checkers by children.

Reference is now made to the drawings in greater detail, and more particularly to FIGS. 1 through 3 at this time, wherein the reference numeral 10 represents a child's toy tent chess board according to the present invention wherein there is a conventional chess board 11 and a special cover 12 that is removably placable upon the board so that together they form a case 13 within which the playing pieces 14 may be stored when not in use.

The chess board 11 has a playing field 15 on one side comprised of 64 square spaces 16 made up in eight rows of eight spaces each, and each alternate space being of a different color such as red and black.

The cover 12 comprises a thin shell preferably made in one piece of molded plastic and is in the shape of a circus tent by including a simulated top canopy 17, surrounding side wall 18 draped downwardly therebelow, flag poles 19 extending upwardly above the top canopy and flying flags 20, the side flagpoles being inclined so to suggest comprising extensions of tent poles therebelow under the canopy, ropes 21 flying penants 22 and the side wall 18 having grooved lines molded therein suggesting a main entrance 23. The various above details of the tent may be made in different colors so to be attractive to a child.

The cover is attachable to the chess board by means of permanent magnets 24 being imbedded along a lower edge 25 of the cover, and the chess board having a sheet of steel 26 forming its top surface which is lithographed with the playing field design, or being a laminated immediately under a thin top paper sheet that is printed with the playing field. The playing pieces 14 may accordingly include magnets within their bases for securement likewise thereto.

To attach the cover to the board, the cover is simply lowered thereupon as shown in FIG. 1, and they are thus held together so to form the case. The case can be readily carried by the center flag pole 19 having a circular disc 27 formed at its upper end above the flag 20, so that a child simply fits the fingers 28 of his hand 29 under the disc, as shown in FIG. 2, in order to lift the case and transport it.

In FIG. 4, a modified design of child's toy tend chess board 30 includes a chess board 31 and cover 32 which are pivotally secured together. The chess board is the same as above described chess board 11. The cover is likewise the same as above described cover 12 except that it is made in two halves 33 hingedly attached together by a hinge 34 being formed along a mating corner thereof receiving a hinge pin 35 that extends also through the chessboard so that all three components are thus pivotally held together. In a stored position, the halves 33 are pivoted toward each other over the chess board, as suggested by arrows 36, so to form an enclosure thereabove that has a shape of a circus tent similar to cover 12. A tab 37 on each half 33 has a hole 38 for overlapping each other and over a threaded hole 39 in the chess board for receiving a screw 40 so to firmly hold the free ends of the halves to the chess board when in a closed position for being carried.

When the chess board is desired to be used to play a game, the halves 33 are pivoted outwardly, as shown in FIG. 4, so to expose the chess board playing field for use. In this position, each half 33 serves as a storage compartment for chess playing pieces that are "captured" by an opponent during the progress of a game. Each half 33 has an inclined shelf 41 there-within having rows of pockets 42 in each of which a playing piece can be fitted. The pockets may be fitted with a steel plate bottom so to hold the magnet-based playing pieces.

When the playing pieces sit in the pockets 42 they give the appearance of an audience sitting in a circus tent grandstand watchin a chess game tournament, all of which further stirs the imagination of a child playing with the present invention.

A sufficient number of pockets 42 may be provided so that both a set of chess pieces and a set of checkers playing pieces can be stored therein, and both sets are thus included in a retail sale of the present invention.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A child's toy tent chess board, comprising in combination, a chess board and a removable cover above said chess board, said cover being in the shape and ornamental appearance of a circus tent, said chess board and cover together forming a case enclosing playing pieces for said chess board, wherein said cover includes a circular disc upon an upper end of a center, upwardly extending pole for forming a handle for carrying said case in a hand.

2. The combination as set forth in claim 1 wherein said chess board includes a steel sheet laminated therewith, and a lower edge of said circus tent shaped cover has magnets imbedded therewithin.

3. The combination as set forth in claim 1 wherein said cover is made in two halves hinged connected together and to said chessboard.

4. The combination as set forth in claim 3 wherein a grandstand-shaped, inclined shelf inside each said half includes rows of pockets in which said playing pieces are placeable for storage.

* * * * *